US011738973B2

(12) United States Patent
Lu et al.

(10) Patent No.: US 11,738,973 B2
(45) Date of Patent: Aug. 29, 2023

(54) GEAR-TRACK-DETACHABLE DRIVING DEVICE IN MONORAIL CRANE SUITABLE FOR STEEP SLOPE

(71) Applicants: CHINA UNIVERSITY OF MINING AND TECHNOLOGY, Xuzhou (CN); XUZHOU LIREN MONORAIL TRANSPORTATION EQUIPMENT CO., LTD., Xuzhou (CN)

(72) Inventors: Hao Lu, Xuzhou (CN); Zhencai Zhu, Xuzhou (CN); Yidong Zhang, Xuzhou (CN); Yuxing Peng, Xuzhou (CN); Mai Du, Xuzhou (CN); Hengzhen Hu, Xuzhou (CN); Fuping Zheng, Xuzhou (CN); Yu Tang, Xuzhou (CN)

(73) Assignees: CHINA UNIVERSITY OF MINING AND TECHNOLOGY, Xuzhou (CN); XUZHOU LIREN MONORAIL TRANSPORTATION EQUIPMENT CO., LTD., Xuzhou (CN)

( * ) Notice: Subject to any disclaimer, the term of this patent is extended or adjusted under 35 U.S.C. 154(b) by 0 days.

(21) Appl. No.: 18/001,311
(22) PCT Filed: Mar. 25, 2022
(86) PCT No.: PCT/CN2022/082955
§ 371 (c)(1),
(2) Date: Dec. 9, 2022
(87) PCT Pub. No.: WO2023/000704
PCT Pub. Date: Jan. 26, 2023
(65) Prior Publication Data
US 2023/0192453 A1 Jun. 22, 2023
(30) Foreign Application Priority Data
Jul. 20, 2021 (CN) ..... 202110817632.7
(51) Int. Cl.
*B66C 9/14* (2006.01)
*B66C 11/06* (2006.01)
*B66C 15/00* (2006.01)
(52) U.S. Cl.
CPC ..... *B66C 11/06* (2013.01); *B66C 9/14* (2013.01); *B66C 15/00* (2013.01)
(58) Field of Classification Search
CPC ..... B66C 11/06; B66C 9/14; B66C 15/00; B66C 11/04; B66C 7/02; B66C 9/04; B61B 13/02; B61B 7/06
See application file for complete search history.

(56) References Cited

U.S. PATENT DOCUMENTS 2,617,365 A * 11/1952 Martin ..... B61C 13/04 100/902
5,924,365 A * 7/1999 Pircher ..... B61C 13/04 105/155

(Continued)

FOREIGN PATENT DOCUMENTS

| | | | |
|---|---|---|---|
| CN | 202785317 | U | 3/2013 |
| CN | 207890917 | U | 9/2018 |
| CN | 208577355 | U | 3/2019 |
| CN | 208577358 | U | 3/2019 |
| CN | 208791036 | U | 4/2019 |

(Continued)

OTHER PUBLICATIONS

Written Opinion of the International Searching Authority issued in International application No. PCT/CN2022/082955 dated May 6, 2022; National Intellectual Property Administration, PRC, Beijing, City, China; 10 pgs.

(Continued)

*Primary Examiner* — Mark T Le
(74) *Attorney, Agent, or Firm* — HAUPTMAN HAM, LLP

(57) ABSTRACT

A gear-track-detachable driving device in a monorail crane for a steep slope includes a driving mechanism, a traveling mechanism, a four-bar linkage mechanism, a connection mechanism, a meshing track plate and transition track plates. The driving mechanism includes driving motors, meshing gears, a bearing rod, and a bearing plate. The traveling mechanism includes traveling wheels, clamping wheels, a shell and telescopic struts. The linkage mechanism includes first and second rockers, a linkage, and a cylinder. The connection mechanism includes fixation plates, a connection (Continued)

plate and connection bolts. When the crane travels to the slope front, the cylinder drives the linkage mechanism to send the meshing gears onto the transition track and adjusts the linkage mechanism into a dead point state, and the telescopic struts are locked. After the crane enters the slope, the meshing gears cooperate with the meshing track plate to provide an auxiliary drive for the crane.

10 Claims, 3 Drawing Sheets

(56) References Cited

U.S. PATENT DOCUMENTS

| | | | | |
|---|---|---|---|---|
| 6,220,174 | B1 * | 4/2001 | Gudel | E01B 25/04 105/29.1 |
| 2009/0095698 | A1 * | 4/2009 | Zaguroli, Jr. | B66D 3/18 212/331 |
| 2019/0337727 | A1 * | 11/2019 | Wireman | B61B 13/02 |

FOREIGN PATENT DOCUMENTS

| | | | |
|---|---|---|---|
| CN | 113620171 | A | 11/2021 |
| EP | 1553042 | A1 | 7/2005 |

OTHER PUBLICATIONS

International Search Report issued in International application No. PCT/CN2022/082955; dated May 6, 2022; National Intellectual Property Administration, PRC, Beijing, City, China; 5 pgs.

* cited by examiner

GEAR-TRACK-DETACHABLE DRIVING DEVICE IN MONORAIL CRANE SUITABLE FOR STEEP SLOPE

RELATED APPLICATIONS

The present application is a U.S. National Phase of International Application Number PCT/CN2022/082955, filed Mar. 25, 2022, and claims priority to Chinese Application Number 202110817632.7, filed Jul. 20, 2021.

TECHNICAL FIELD

The present disclosure relates to the field of transportation equipment, and in particular to a gear-track-detachable driving device in a monorail crane suitable for a steep slope.

BACKGROUND

As modern efficient auxiliary transportation equipment, monorail cranes have great application value in special occasions such as coal mine roadway and railway tunnel. Main advantages of the monorail cranes lie in the followings. Firstly, suspended track transportation is adopted, which is easy to install and maintain, free from influences of bottom conditions in roadways, and convenient for a material loading, a material unloading and a material transportation. Secondly, with a strong environmental adaptability, it is capable of realizing an overall handling and long-distance direct transportation of equipment in a complex coal seam and a roadways with more curved turnouts. Thirdly, less staff are occupied, and the supporting system is complete, the operation is simple, and the automation degree of the operation is high. However, the monorail crane also has problems such as insufficient climbing power when operating on steep slopes at present.

SUMMARY

In view of the above-mentioned technical deficiencies, the objectives of the present disclosure are to provide a gear-track-detachable driving device in a monorail crane suitable for a steep slope, which can provide auxiliary power when the monorail crane climbs a slope, prevent problems such as skidding and rolling due to the insufficient power of the device, ensure safety of operators, and achieve safe transportation.

In order to achieve the above-mentioned objectives, the following technical solutions are adopted in the present disclosure.

Provided is a gear-track-detachable driving device in a monorail crane suitable for a steep slope. The device includes a driving mechanism, a traveling mechanism, a four-bar linkage mechanism, a connection mechanism, a meshing track and a transition track.

The driving mechanism includes two driving motors arranged in bilateral symmetry, two meshing gears mounted coaxially with the driving motors, two upper and lower bearing rods configured to fix two sets of driving motors, and a bearing plate connecting the two bearing rods.

The traveling mechanism includes a traveling mechanism shell, traveling wheels and clamping wheels configured to drive the traveling mechanism shell to move, and telescopic struts configured to lock the traveling mechanism shell uni-directionally.

The four-bar linkage mechanism includes a first rocker fixed on one side of the bearing plate, a linkage hinged with the first rocker, a second rocker driven by and connected with the first rocker through the linkage, a cylinder configured to drive the second rocker, and the first rocker, the second rocker, and the cylinder are further hinged with the traveling mechanism shell respectively.

The connection mechanism includes a connection plate, fixation plates configured to connect and mount the connection plate, and connection bolts configured to connect with external structures. The connection plate is connected with the traveling mechanism shell through the fixation plates, and the connection bolts is connected with the connection plate through the fixation plates.

The meshing track includes a steep slope I-beam and a meshing track plate mounted at a bottom portion of the lower wing plate of the steep slope I-beam steel. The transition track includes steep slope transition I-beam steels and transition track plates mounted at bottom portions of the lower wing plates of the steep slope transition I-beam steels. The transition track plates are distributed at a front side and a rear side of the meshing track plate. The steep slope I-beam steel, the meshing track plate, the steep slope transition I-beam steels and the transition track plates are combined into a steep slope traveling track. The traveling mechanism shell travels on a lower wing plate of an I-beam steel through the traveling wheels, the clamping wheels clamps web plates of the I-beam steel on both sides according to abrasion conditions, and the traveling mechanism shell is further engaged with the steep slope traveling track through the meshing gears.

Preferably, the two driving motors arranged in bilateral symmetry operate in cooperation with each other, and the two meshing gears keep consistent with each other when engaging with a track. The driving motors are replaceable with different types of motors or hydraulic motors according to different working conditions.

Preferably, two pairs of the traveling wheels and two pairs of clamping wheels are provided. Both the traveling wheels and the clamping wheels are mounted in bilateral symmetry inside the traveling mechanism shell. The telescopic struts are symmetrically mounted at both sides of the traveling mechanism shell, and both ends of the telescopic struts are hinged with the upper bearing rod and the traveling mechanism shell, respectively.

Each of the telescopic struts includes a slide bar, a convex block, a position-limiting block, a securing nut, and a mounting rod. The slide bar is slidingly inserted with the mounting rod. One side at a top of the slide bar is provided with a slide bar bayonet, and another side at a top of the mounting rod is provided with a mounting rod bayonet. The convex block is fixed on an inner wall of the slide bar at a side away from the slide bar bayonet, and the position-limiting block is pinned-jointed to a bottom portion of an inner wall of the mounting rod at a side proximate to the mounting rod bayonet through the securing nut. The convex block pushes the position-limiting block to rotate when the slide bar is sliding inside the mounting rod.

Preferably, one end of the first rocker is hinged with one end of the linkage, another end of the linkage is hinged with one end of the second rocker, a middle section of the first rocker and another end of the second rocker are hinged with the traveling mechanism shell respectively. The cylinder is hinged at a bottom portion of the traveling mechanism shell for mounting, a piston rod of the cylinder is hinged with a middle section of the second rocker, and another end of the first rocker is welded with the bearing plate. When the monorail crane travels onto the transition track, the cylinder adjusts the second rocker to be in a same line with the linkage, and the four-bar linkage mechanism enters a state of a dead point. The telescopic struts are not capable of extending after being locked in a uni-directional contraction to ensure that the gears and the track are capable of operating without cooperation issues of an excessive extrusion or an insufficient meshing.

Preferably, the connection plate is fixedly installed on a left outer wall and a right outer wall of the traveling mechanism shell through two sets of the fixation plates in bilateral symmetry. The connection bolts are fixedly installed on a rear plate of the connection plate through a set of the fixation plates. An upper one of the connection plates is further fixedly connected with a bottom portion of the traveling mechanism shell through bolts. An auxiliary driving device with the monorail crane is externally connected to a whole vehicle of the monorail crane through the connection bolts, and runs with the monorail crane by means of the traveling mechanism when no auxiliary power is required.

Preferably, the I-beam steel includes the steep slope I-beam steel and the steep slope transition I-beam steels distributed at a front side and a rear side of the steep slope I-beam steel. The meshing track plate is laid at the bottom portion of the lower wing plate of the steep slope I-beam steel, and the transition track plates are laid at the bottom portions of the lower wing plates of the steep slope transition I-beam steels. The meshing track plate is welded with the transition track plates from head to tail, the meshing track plate is welded with the lower wing plates of the steep slope transition I-beam steels, and the transition track plates are welded with the lower wing plates of the steep slope transition I-beam steels through a plurality of thick springs.

Preferably, in the case where a tooth-tip-collision occurs when the meshing gears enter the transition track, the transition track plates compress the thick springs to yield certain space until the meshing gears engage with the transition track smoothly.

Preferably, when the monorail crane travels on a front transition track, the telescopic struts cooperate with actions of retreating and resetting of the transition track plates to enter a uni-directional locked state, and the slide bar is not capable of extending and sliding in the mounting rod. When the monorail crane travels on a rear transition track, the telescopic struts cooperate with actions of retreating and resetting of the transition track plates to break away from the uni-directional locked state, and the slide bar is capable of sliding in the mounting rod freely.

Preferably, when the cylinder drives the piston rod to operate, the second rocker keep a safe distance from the bottom portion of the traveling mechanism shell and the rear plate of the connection plate to prevent a contact damage.

Preferably, the driving motors on both sides keep a safe distance from the lower wing plate of the I-beam steel under a drive of the first rocker to prevent the contact damage.

The beneficial effects of the present disclosure lie in the followings. Provided in present disclosure is as follow. When the monorail crane travels onto the front transition track, the cylinder drives the four-bar linkage mechanism to send the meshing gears onto the transition track, the cylinder adjusts the four-bar linkage mechanism to enter the state of the dead point, and the telescopic struts enter the uni-directional locked state. After entering the meshing track, the driving motors drive the meshing gears to cooperate with the meshing track plate to provide auxiliary power for the monorail crane for climbing the slope, so as to avoid problems such as skidding and rolling due to the insufficient power of the device. When the monorail crane enters the rear transition track, under an action of the cylinder and the four-bar linkage mechanism, the telescopic struts will break away from the uni-directional locked state, and the driving mechanism will break away from the transition track plates, the telescopic struts and the driving mechanism will travel together with the monorail crane means of the monorail crane's own to save energy.

BRIEF DESCRIPTION OF THE DRAWINGS

In order to explain the embodiments of the present disclosure or the technical solutions in the prior art more clearly, the accompanying drawings that need to be used for describing the embodiments or the prior art will be briefly introduced herein. Apparently, the accompanying drawings in the following description are only some embodiments of the present disclosure. For those of ordinary skilled in the art, other accompanying drawings can also be obtained from these accompanying drawings without any creative efforts.

DESCRIPTIONS OF REFERENCE NUMERALS

1. I-beam steel; 2. Meshing gear; 3. Driving motor; 4. Telescopic strut; 5. Traveling mechanism; 6. Fixation plate; 7. Connection plate; 8. Connection bolt; 9. Second rocker; 10. Cylinder; 11. Linkage; 12. First rocker; 13. Bearing plate; 14. Bearing rod; 15. Meshing track plate; 16. Traveling wheel; 17. Clamping wheel; 18. Transition track plate; 19. Thick spring; 41. Slide bar; 42. Convex block; 43. Slide bar bayonet; 44. Position-limiting block; 45. Mounting rod bayonet; 46. Securing nut; 47. Mounting rod.

DETAILED DESCRIPTION OF THE EMBODIMENTS

The technical solutions in the embodiments of the present disclosure will be clearly and completely described below with reference to the accompanying drawings. Apparently, the described embodiments are only a part of the embodiments of the present disclosure, rather than all of the embodiments. Based on the embodiments of the present disclosure, all other embodiments obtained by those of ordinary skilled in the art without any creative efforts shall fall within the protection scope of the present disclosure.

Figure 1:
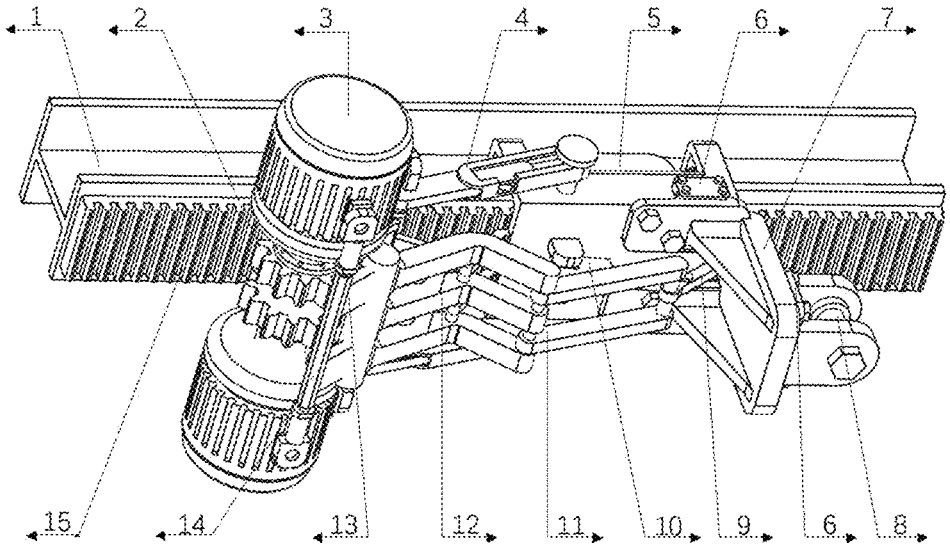
FIG. 1 illustrates a traveling diagram of an auxiliary driving device of a monorail crane on the track in the present disclosure.
Figure 2:
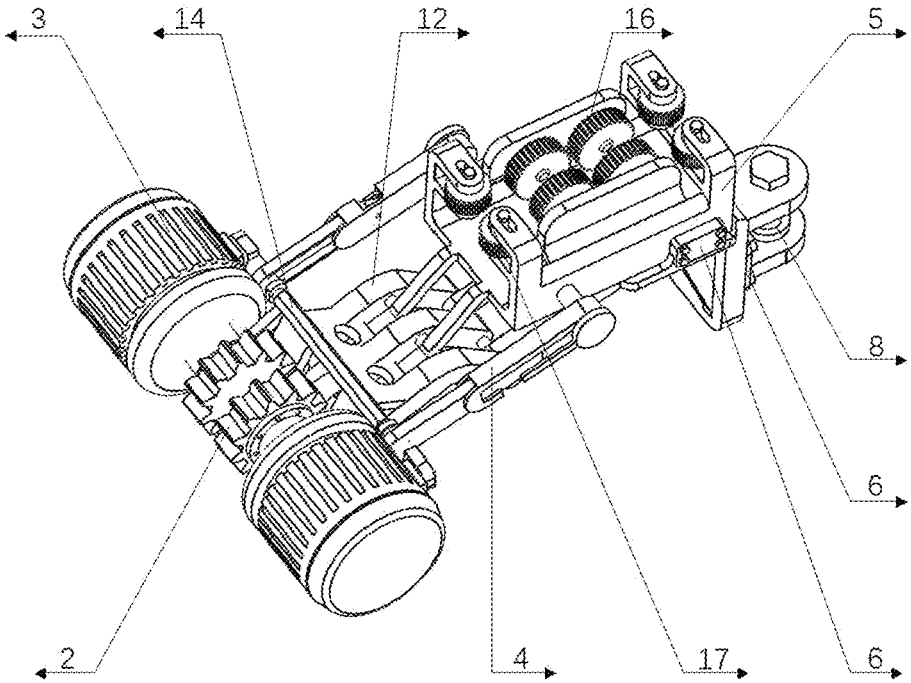
FIG. 2 illustrates a schematic structural diagram of the auxiliary driving device of the monorail crane in the present disclosure.
Figure 3:
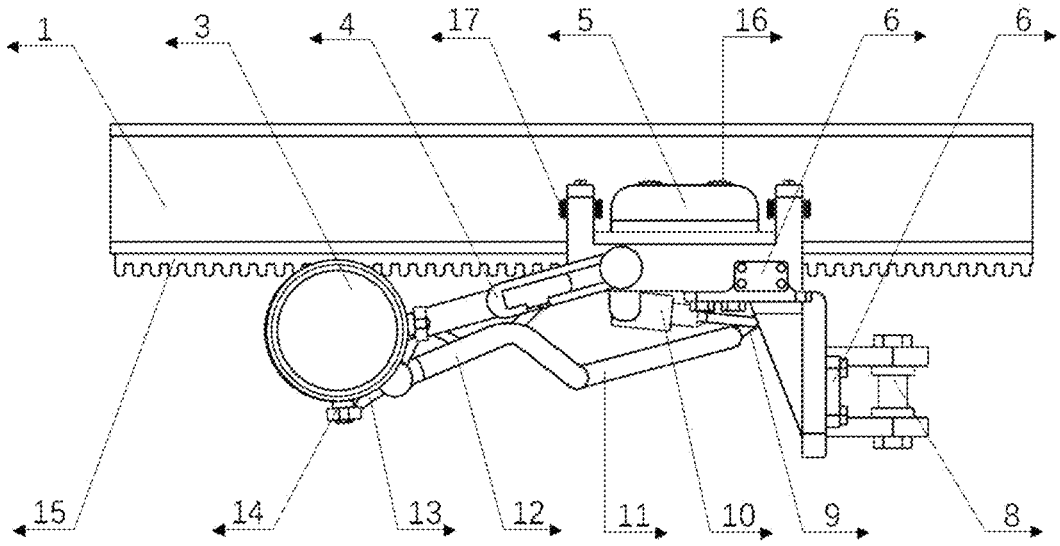
FIG. 3 illustrates a side view of the auxiliary driving device of the monorail crane on the track in the present disclosure.
Figure 4:
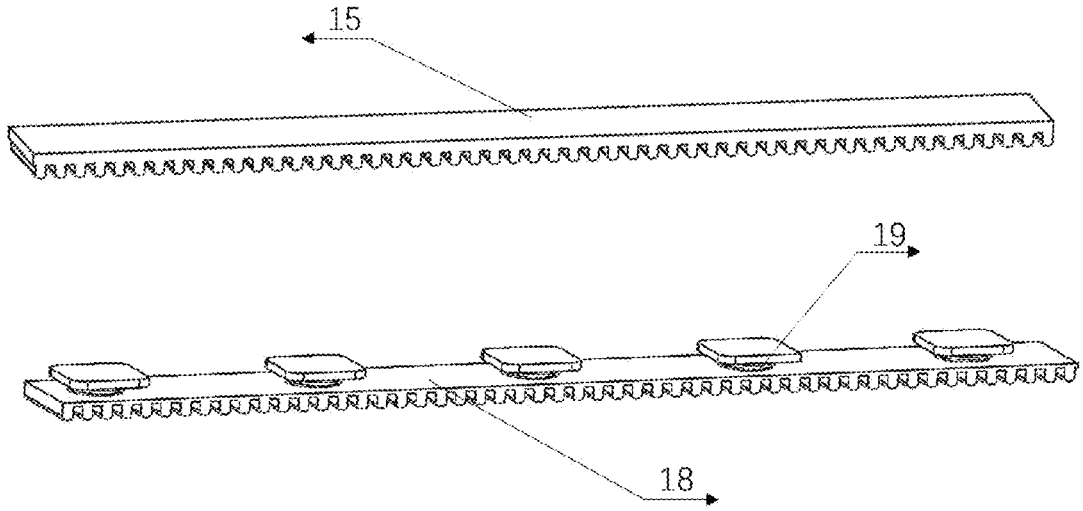
FIG. 4 illustrates a schematic structural diagram of a meshing track plate and transition track plates in the auxiliary driving device of the monorail crane on the track in the present disclosure.
Figure 5:
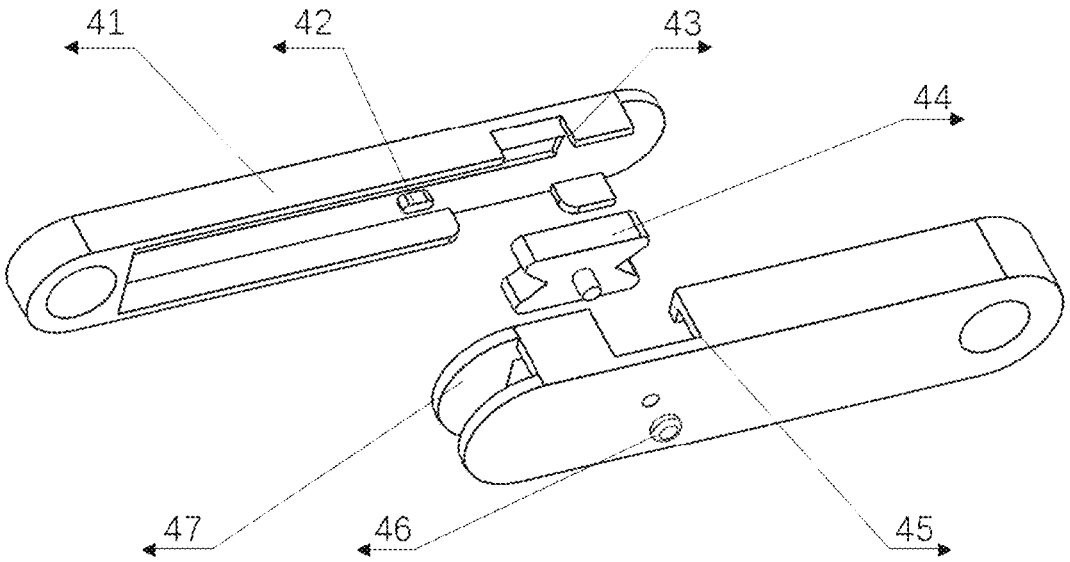
FIG. 5 illustrates an explosion view of telescopic struts in the auxiliary driving device of the monorail crane on the track in the present disclosure.

As illustrated in FIGS. 1 to 5, the present disclosure provides a gear-track-detachable driving device in a monorail crane suitable for a steep slope. The device includes a driving mechanism, a traveling mechanism, a four-bar linkage mechanism, a connection mechanism, a meshing track and a transition track. The driving mechanism includes two driving motors 3 arranged in bilateral symmetry, and two meshing gears 2 mounted coaxially with the driving motors, two upper and lower bearing rods 14, and a bearing plate 13 fixedly connected with the two upper and lower bearing rods 14.

The traveling mechanism includes two pairs of the traveling wheels 16 and two pairs of clamping wheels 17, a traveling mechanism shell 5, and telescopic struts 4. The traveling wheels 16 and the clamping wheels 17 are mounted in bilateral symmetry inside the traveling mechanism shell 5. The telescopic struts 4 are symmetrically mounted at both sides of the traveling mechanism shell 5, and both ends of the telescopic struts 4 are hinged with the upper bearing rod 14 and the traveling mechanism shell 5, respectively.

Each of the telescopic struts 4 includes a slide bar 41, a convex block 42, a position-limiting block 44, a securing nut 46, and a mounting rod 47. The slide bar 41 is slidingly inserted with the mounting rod. One side at the top of the slide bar 41 is provided with a slide bar bayonet 43, and another side of the top of the mounting rod 47 is provided with a mounting rod bayonet 45. The convex block 42 is fixed on an inner wall of the slide bar 41 at the said away from the slide bar bayonet 43, and the position-limiting block 44 is pinned-jointed to the bottom portion of the inner wall of the mounting rod 47 at a side proximate to the mounting rod bayonet 45 through the securing nut 46. When the slide bar 41 perform an retraction action with respect to the mounting rod 47, the convex block 42 pushes the position-limiting block 44 to rotate anticlockwise, and the corners of the position-limiting block 44 extend out of the slide bar bayonet 43 and the mounting rod bayonet 45. When the telescopic struts 4 tend to extend under an external force, the slide bar 41 extends with respect to the mounting rod 47, and the side wall of the slide bar bayonet 43 pushes the position-limiting block 44 to continuously rotating anticlockwise, the position-limiting block 44 is locked and is not capable of further extending, the telescopic struts 4 enter the uni-directional locked state. When the slide bar 41 perform an retraction action again with respect to the mounting rod 47, the side wall of the slide bar bayonet 43 pushes the position-limiting block 44 to rotate clockwise, and the corners of the position-limiting block are put into the mounting rod 47 to keep away from the uni-directional locked state, and the slide bar 41 is capable of performing an extending action with respect to the mounting rod 47.

The four-bar linkage mechanism includes a first rocker 12, a linkage 11, a second rocker 9 and a cylinder 10. One end of the first rocker 12 is hinged with one end of the linkage 11, another end of the linkage 11 is hinged with one end of the second rocker 9, a middle section of the first rocker 12 and another end of the second rocker 9 are hinged with the traveling mechanism shell 5, respectively. The cylinder 10 is hinged at the bottom portion of the traveling mechanism shell 5 for mounting, the piston rod of the cylinder 10 is hinged with the middle section of the second rocker 9, and another end of the first rocker 12 is welded with the bearing plate 13.

The connection mechanism includes fixation plates 6, a connection plate 7 and connection bolts 8. The connection plate 7 is fixedly installed on a left outer wall and a right outer wall of the traveling mechanism shell 5 through two sets of the fixation plates 6 in bilateral symmetry, and the connection bolts 8 are fixedly installed on a rear plate of the connection plate 7 through a set of fixation plates 6. The upper plate of the connection plate 7 is further fixedly connected with the bottom portion of the traveling mechanism shell 5 through bolts.

The meshing track includes a steep slope I-beam steel and a meshing track plate 15. The transition track includes steep slope transition I-beam steels and transition track plates 18. The transition track plates 18 are distributed at the front side and the rear side of the meshing track plate 15. The meshing track plate 15 and the transition track plates 18 are laid at the bottom portion of the I-beam steel, respectively.

The traveling mechanism shell 5 travels on the lower wing plate of the I-beam steel 1 through the traveling wheels 16, the clamping wheels 17 clamps web plate of the I-beam steel 1 on both sides according to abrasion conditions, and the meshing gears 2 are engaged with the meshing track plate 15 or the transition track plates 18.

When the monorail crane travels onto the transition track, the cylinder 10 adjusts the second rocker 9 to be in a same line with the linkage 11, and the four-bar linkage mechanism enters a state of a dead point. The telescopic struts 4 are not capable of extending after being locked in a uni-directional contraction, to ensure that the gears and the track are capable of operating without cooperation issues of an excessive extrusion or an insufficient meshing.

The two driving motors 3 arranged in bilateral symmetry operate in cooperation, and the two meshing gears 2 keep consistent with each other when engaging with the track. The driving motors 3 are replaceable with different types of motors or hydraulic motors according to working conditions.

The auxiliary driving device of the monorail crane is externally connected to a whole vehicle of the monorail crane through the connection bolts 8, and runs with the monorail crane by means of the traveling mechanism when no auxiliary power is required.

The I-beam steel includes the steep slope I-beam steel and the steep slope transition I-beam steels distributed at the front side and the rear side of the steep slope I-beam steel. The meshing track plate 15 is laid at the bottom portion of the lower wing plate of the steep slope I-beam steel, and the transition track plates 18 are laid at the bottom portions of the lower wing plates of the steep slope transition I-beam steels. The meshing track plate 15 is welded with the transition track plates 18 from head to tail, the meshing track plate 15 is welded with the lower wing plates of the steep slope transition I-beam steels, and the transition track plates 18 are welded with the lower wing plates of the steep slope transition I-beam steels for transitions through a plurality of thick springs 19.

In the case where a tooth-tip-collision occurs when the meshing gears enter the transition track, the transition track plates 18 compress the thick springs 19 to yield certain space until the meshing gears 2 engage with the transition track smoothly.

When the monorail crane travels on a front transition track, the telescopic struts 4 cooperate with actions of retreating and resetting of the transition track plates 18 to enter a uni-directional locked state, and the slide bar 41 is not capable of extending and sliding in the mounting rod 47. When the monorail crane travels on a rear side of the transition track, the telescopic struts 4 cooperate with actions of retreating and resetting of the transition track plates 18 to break away from the uni-directional locked state, and the slide bar 41 is capable of sliding in the mounting rod 47 freely.

When the cylinder 10 drives the piston rod to operate, the second rocker 9 keep a safe distance from the bottom portion of the traveling mechanism shell 5 and the rear plate of the connection plate 7 to prevent a contact damage.

The driving motors 3 on both sides keep a safe distance from the lower wing plate of the I-beam steel (1) under a drive of the first rocker 12 to prevent the contact damage.

The operation principles lie in the following.

The auxiliary driving device of the monorail crane is installed on the I-beam steel 1 through the traveling wheels 16 and the clamping wheels 17, and connected with the whole vehicle of the monorail crane through the connection bolts 8 at the rear side of the device. When driving in an ordinary I-beam steel section, the piston rod of the cylinder 10 is in an extending state, the meshing gears 2 of the driving mechanism are far away from the lower wing plate of the I-beam steel 1 under the action of the four-bar linkage mechanism and the telescopic struts 4, the telescopic struts 4 are in an extending state, and the whole device travels with the monorail crane through the traveling mechanism.

When traveling onto the front transition track, the piston rod of the cylinder 10 retracts and drives the four-bar linkage mechanism to lift the driving mechanism up. The thick springs 19 arranged at the bottom portions of the transition track plates 18 help the meshing gears 2 to mesh with the transition track smoothly. The second rocker 9 is in the same line with the linkage 11 to so that the four-bar linkage mechanism enters the state of the dead point, and the telescopic struts 4 also enter the uni-direction locked state and are not capable of extending.

After traveling onto the meshing track, the driving motor 3 is activated to provide auxiliary power for the monorail crane to climb. With the help of the dead point characteristics of the four-bar linkage mechanism and the uni-directional locked characteristics of the telescopic struts 4, the power supply process of the auxiliary driving device of the monorail crane is more stable and safe.

When traveling onto the rear transition track, the piston rod of the cylinder 10 retracts and is in cooperation with the transition track, the telescopic struts 4 keep away from the uni-directional locked state. The piston rod of the cylinder 10 extends, and the driving mechanism of the device is driven by the four-bar linkage mechanism and the telescopic strut 4 to disengage from the I-beam steel 1 smoothly.

In the description of the present disclosure, it should be noted that the orientations or positional relationships indicated by the terms "center", "upper", "lower", "left", "right", "vertical", "horizontal", "inner", "outer", etc., are those based on the orientations or positional relationships illustrated in the drawings, and are only for convenience of description and simplicity of description, but do not indicate or imply that the device or element being referred to must have a particular orientation, be constructed and operated in a particular orientation, and thus, should not be construed as limiting the present disclosure. Furthermore, the terms "first, " "second," and "third" are used for descriptive objectives only and are not to be construed as indicating or implying relative importance.

In the description of the present disclosure, it should be noted that, unless otherwise explicitly specified or limited, the terms "mounted," "connected with," and "connected to" should be understood in a broad sense, for example, it may be a fixed connection, a detachable connection, or an integral connection; it may be a mechanical connection or an electrical connection; it may be a direct connection or may also be indirectly connected through an intermediate medium, and it may be the internal communication of two elements. The specific meanings of the above terms in the present disclosure can be understood in specific situations for those skilled in the art.

The examples given in the present disclosure are not limited to the embodiments. It will be apparent to those skilled in the art that, although it is not necessary and impossible to list all the implementations herein, other variations and modifications may be made in the foregoing disclosure without departing from the spirits or essential characteristics of all implementations, and that the obvious variations or modifications derived therefrom still fall within the protection scope of the present disclosure.

What is claimed is:

1. A gear-track-detachable driving device in a monorail crane suitable for a steep slope, wherein the device comprises: a driving mechanism, a traveling mechanism, a four-bar linkage mechanism, a connection mechanism, a meshing track and a transition track; the driving mechanism includes two driving motors arranged in bilateral symmetry, two meshing gears mounted coaxially with the driving motors, two upper and lower bearing rods configured to fix two sets of driving motors, and a bearing plate connecting the two bearing rods; the traveling mechanism includes a traveling mechanism shell, traveling wheels and clamping wheels configured to drive the traveling mechanism shell to move, and telescopic struts configured to lock the traveling mechanism shell uni-directionally;

the four-bar linkage mechanism includes a first rocker fixed on one side of the bearing plate, a linkage hinged with the first rocker, a second rocker driven by and connected with the first rocker through the linkage, a cylinder configured to drive the second rocker, and the first rocker, the second rocker, and the cylinder are further hinged with the traveling mechanism shell respectively; the connection mechanism includes a connection plate, fixation plates configured to connect and mount the connection plate, and at least one connection bolt configured to connect with external structures, wherein the connection plate is connected with the traveling mechanism shell through the fixation plates, and the at least one connection bolt is connected with the connection plate through the fixation plates, and the meshing track includes a steep slope I-beam steel and a meshing track plate mounted at a bottom portion of a lower wing plate of the steep slope I-beam steel, the transition track includes steep slope transition I-beam steels and transition track plates mounted at bottom portions of lower wing plates of the steep slope transition I-beam steels, wherein the transition track plates are distributed at a front side and a rear side of the meshing track plate, the steep slope I-beam steel, the meshing track plate, the steep slope transition I-beam steels and the transition track plates are combined into a steep slope traveling track, the traveling mechanism shell travels on a lower wing plate of an I-beam steel through the traveling wheels, the clamping wheels are adapted to the I-beam steel, and the traveling mechanism shell is further engaged with the steep slope traveling track through the meshing gears.

2. The gear-track-detachable driving device in the monorail crane suitable for the steep slope according to claim 1, wherein the two driving motors arranged in bilateral symmetry operate in cooperation with each other, and the two meshing gears keep consistent with each other when engaging with the track, wherein the driving motors are replaceable with different types of motors or hydraulic motors according to different working conditions.

3. The gear-track-detachable driving device in the monorail crane suitable for the steep slope according to claim 2, wherein two pairs of the traveling wheels and two pairs of clamping wheels are provided, both the traveling wheels and the clamping wheels are mounted in bilateral symmetry inside the traveling mechanism shell, the telescopic struts are symmetrically mounted at both sides of the traveling mechanism shell, and both ends of the telescopic struts are hinged with the upper bearing rod and the traveling mechanism shell, respectively; and each of the telescopic struts includes a slide bar, a convex block, a position-limiting block, a securing nut, and a mounting rod, wherein the slide bar is slidingly inserted with the mounting rod, one side at a top of the slide bar is provided with a slide bar bayonet, and another side at a top of the mounting rod is provided with a mounting rod bayonet, the convex block is fixed on an inner wall of the slide bar at a side away from the slide bar bayonet, the position-limiting block is pinned-jointed to a bottom portion of an inner wall of the mounting rod at a side proximate to the mounting rod bayonet through the securing nut, and the convex block pushes the position-limiting block to rotate when the slide bar is sliding inside the mounting rod.

4. The gear-track-detachable driving device in the monorail crane suitable for the steep slope according to claim 3, wherein one end of the first rocker is hinged with one end of the linkage, another end of the linkage is hinged with one end of the second rocker, a middle section of the first rocker and another end of the second rocker are hinged with the traveling mechanism shell respectively, the cylinder is hinged at a bottom portion of the traveling mechanism shell for mounting, a piston rod of the cylinder is hinged with a middle section of the second rocker, and another end of the first rocker is welded with the bearing plate, wherein when the monorail crane travels onto the transition track, the cylinder adjusts the second rocker to be in a same line with the linkage, and the four-bar linkage mechanism enters a state of a dead point, and the telescopic struts are not capable of extending after being locked in a uni-directional contraction to ensure that the gears and the track are capable of operating without cooperation issues of an excessive extrusion or an insufficient meshing.

5. The gear-track-detachable driving device in the monorail crane suitable for the steep slope according to claim 4, wherein the connection plate is fixedly installed on a left outer wall and a right outer wall of the traveling mechanism shell through two sets of the fixation plates in bilateral symmetry, the at least one connection bolt is fixedly installed on a rear plate of the connection plate through a set of the fixation plates, an upper one of the connection plates is further fixedly connected with a bottom portion of the traveling mechanism shell through bolts, an auxiliary driving device of the monorail crane is externally connected to a whole vehicle of the monorail crane through the at least one connection bolt, and runs with the monorail crane by means of the traveling mechanism when no auxiliary power is required.

6. The gear-track-detachable driving device in the monorail crane suitable for the steep slope according to claim 5, wherein the I-beam steel includes the steep slope I-beam steel and the steep slope transition I-beam steels distributed at a front side and a rear side of the steep slope I-beam steel, the meshing track plate is laid at the bottom portion of the lower wing plate of the steep slope I-beam steel, the transition track plates are laid at the bottom portions of the lower wing plates of the steep slope transition I-beam steels, the meshing track plate is welded with the transition track plates from head to tail, the meshing track plate is welded with the lower wing plates of the steep slope transition I-beam steels, and the transition track plates are welded with the lower wing plates of the steep slope transition I-beam steels through a plurality of thick springs.

7. The gear-track-detachable driving device in the monorail crane suitable for the steep slope according to claim 6, wherein in the case where a tooth-tip-collision occurs when the meshing gears enter the transition track, the transition track plates compress the thick springs to yield certain space until the meshing gears engage with the transition track smoothly.

8. The gear-track-detachable driving device in the monorail crane suitable for the steep slope according to claim 7, wherein when the monorail crane travels on a front transition track, the telescopic struts cooperate with actions of retreating and resetting of the transition track plates to enter a uni-directional locked state, and the slide bar is not capable of extending and sliding in the mounting rod; and when the monorail crane travels on a rear transition track, the telescopic struts cooperate with actions of retreating and resetting of the transition track plates to break away from the uni-directional locked state, and the slide bar is capable of sliding in the mounting rod freely.

9. The gear-track-detachable driving device in the monorail crane suitable for the steep slope according to claim 8, wherein when the cylinder drives the piston rod to operate, the second rocker keep a safe distance from the bottom portion of the traveling mechanism shell and the rear plate of the connection plate to prevent a contact damage.

10. The gear-track-detachable driving device in the monorail crane suitable for the steep slope according to claim 9, wherein the driving motors on both sides keep a safe distance from the lower wing plate of the I-beam steel under a drive of the first rocker to prevent the contact damage.

* * * * *